US009839296B2

(12) United States Patent
Ballendat et al.

(10) Patent No.: US 9,839,296 B2
(45) Date of Patent: Dec. 12, 2017

(54) MECHANISM FOR AN OFFICE CHAIR

(71) Applicant: BOCK 1 GMBH & CO. KG, Postbauer-Heng (DE)

(72) Inventors: Martin Ballendat, Braunau am Inn (AT); Hermann Bock, Pyrbaum (DE)

(73) Assignee: Bock 1 GmbH & Co. KG, Postbauer-Heng (DE)

( * ) Notice: Subject to any disclaimer, the term of this patent is extended or adjusted under 35 U.S.C. 154(b) by 0 days.

(21) Appl. No.: 14/903,496

(22) PCT Filed: Jul. 7, 2014

(86) PCT No.: PCT/EP2014/001864

§ 371 (c)(1),
(2) Date: Apr. 18, 2016

(87) PCT Pub. No.: WO2015/003796

PCT Pub. Date: Jan. 15, 2015

(65) Prior Publication Data

US 2016/0235205 A1 Aug. 18, 2016

(30) Foreign Application Priority Data

Jul. 7, 2013 (DE) ..... 20 2013 102 990 U

(51) Int. Cl.

| | |
|---|---|
| ***A47C 1/024*** | (2006.01) |
| ***A47C 3/026*** | (2006.01) |
| ***A47C 7/44*** | (2006.01) |
| ***A47C 1/022*** | (2006.01) |
| ***A47C 7/00*** | (2006.01) |
| ***A47C 7/40*** | (2006.01) |

(52) U.S. Cl.
CPC ..... *A47C 7/44* (2013.01); *A47C 1/022* (2013.01); *A47C 7/004* (2013.01); *A47C 7/40* (2013.01); *A47C 7/448* (2013.01)

(58) Field of Classification Search
CPC .. A47C 7/44; A47C 7/004; A47C 7/40; A47C 7/448; A47C 1/022
USPC ..... 297/314, 302.1, 354.1, 285, 292–299
See application file for complete search history.

(56) References Cited

U.S. PATENT DOCUMENTS 2,184,988 A * 12/1939 Collier ..... A47C 3/026 236/1 F
2,799,323 A * 7/1957 Berg ..... A47C 3/025 297/314 X (Continued)

FOREIGN PATENT DOCUMENTS

DE 9217661 U1 2/1993
DE 102010033021 * 2/2012 ..... A47C 3/0252
EP 0022933 A1 1/1981

*Primary Examiner* — Rodney B White
(74) *Attorney, Agent, or Firm* — Laurence A. Greenberg; Werner H. Stemer; Ralph E. Locher

(57) ABSTRACT

A mechanism for an office chair is structurally particularly simple and consequently comparatively inexpensive, but nevertheless extremely variable. Both the seat support and the backrest support are articulated by way of a common pivot axis. The seat support is connected in an articulated manner to the base support by way of at least one pivot bolt and is pivotable relative to the base support. The backrest support is connected in an articulated manner to the base support by way of the at least one pivot bolt and is pivotable relative to the base support.

11 Claims, 14 Drawing Sheets

(56) References Cited

U.S. PATENT DOCUMENTS 3,863,982 A * 2/1975 Sandham ..... A47C 7/448 297/302.1 X
3,989,297 A 11/1976 Kerstholt
4,131,260 A * 12/1978 Ambasz ..... A47C 3/026 248/599
4,364,605 A 12/1982 Meiller
4,640,548 A * 2/1987 Desanta ..... A47C 1/03255 297/300.1
4,890,886 A * 1/1990 Opsvik ..... A47C 3/025 248/596
5,035,466 A * 7/1991 Mathews ..... A47C 1/023 248/561
5,054,857 A 10/1991 Kvalheim
5,577,803 A * 11/1996 Guilbaud ..... A47C 1/0244 297/314 X
5,649,740 A * 7/1997 Hodgdon ..... A47C 1/03255 248/575
6,019,422 A * 2/2000 Taormino ..... B62J 1/04 297/314 X
6,033,021 A * 3/2000 Udo ..... A47C 9/002 297/314 X
6,116,687 A * 9/2000 Vogtherr ..... A47C 3/026 297/291
6,176,548 B1 * 1/2001 Thole ..... A47C 3/026 297/302.1
6,209,958 B1 * 4/2001 Thole ..... A47C 3/026 297/302.1
6,481,795 B1 * 11/2002 Pettibon ..... A47C 3/02 297/314 X
6,523,895 B1 * 2/2003 Vogtherr ..... A47C 1/024 297/291
6,588,843 B1 * 7/2003 Ebenstein ..... A47C 1/03238 297/302.1 X
6,685,268 B2 * 2/2004 Meyer ..... A47C 9/002 297/314 X
6,688,689 B1 * 2/2004 Thorn ..... A47C 3/0252 297/302.1 X
6,863,017 B2 * 3/2005 Charles ..... B60N 2/2839 297/314 X
6,874,853 B2 * 4/2005 Wild ..... A47C 1/03255 297/302.1 X
7,100,983 B1 * 9/2006 Gant ..... A47C 7/14 297/314 X
7,396,080 B2 * 7/2008 Suhr ..... A47C 3/026 297/313
7,434,880 B2 * 10/2008 Ronnestad ..... A47C 7/445 297/313
7,547,067 B2 * 6/2009 Keilhauer ..... A47C 3/02 297/314 X
7,686,396 B2 * 3/2010 Schaaf ..... A47C 7/14 297/314 X
7,789,463 B2 * 9/2010 Gang ..... A47C 3/0252 297/314 X
7,806,479 B2 * 10/2010 Jensen ..... A47C 9/002 248/158
7,922,247 B2 * 4/2011 Dickie ..... A47C 7/446 297/314 X
8,439,442 B2 * 5/2013 Highlander ..... A47C 7/14 297/314 X
9,060,612 B2 * 6/2015 Lee ..... A47C 7/14
9,681,750 B2 * 6/2017 Smith ..... A47C 1/024
2002/0043846 A1 * 4/2002 Brauning ..... A47C 3/026 297/314
2009/0102268 A1 * 4/2009 Schmitz ..... A47C 1/03255 297/452.19
2009/0261642 A1 * 10/2009 Dickie ..... A47C 7/446 297/314
2010/0001567 A1 * 1/2010 Powicki ..... A47C 1/023 297/302.1 X
2013/0082499 A1 * 4/2013 Schmitz ..... A47C 1/03255 297/285
2013/0113253 A1 * 5/2013 Meyer ..... A47C 3/0252 297/302.1
2014/0077542 A1 * 3/2014 Vander Veen ..... A47C 1/032 297/228.11
2014/0239686 A1 * 8/2014 Christianson ..... A47C 1/023 297/301.1
2015/0245713 A1 * 9/2015 Desanta ..... A47C 1/032 297/316
2016/0081478 A1 * 3/2016 Ehrenleitner ..... A47C 3/18 297/314
2016/0081483 A1 * 3/2016 Harrison ..... A47C 31/126 297/217.2

* cited by examiner

MECHANISM FOR AN OFFICE CHAIR

BACKGROUND OF THE INVENTION

Field of the Invention

The invention relates to a mechanism for an office chair.

Synchronous mechanisms and tilt mechanisms are known, among other things, as mechanisms for office chairs. The term synchronous mechanism is to be understood, in this case, as assemblies in the seat substructure of an office chair which provide kinematics coupling together the seat and the backrest and bringing about a certain relative movement with respect to one another. The seat of the office chair, which is generally speaking provided with an upholstered sitting surface, is mounted on the seat support. The backrest support, which commonly extends rearward from the actual synchronous mechanism, supports the backrest of the office chair on an upwardly extending cantilever. The seat support and the backrest support are usually coupled together in an articulated manner in such a manner that when the backrest is pivoted backward—as can be produced, for example, by the user of the chair leaning against the backrest—this causes the rear edge of the seat to be lowered down. As a result, the so-called "shirt riding-up effect" should be prevented and sitting comfort increased. These types of synchronous mechanisms are frequently very costly to construct and are consequently expensive to produce.

Tilt mechanisms, in contrast, are comparatively simply constructed assemblies in the seat substructure of chairs where the backrest support is connected in a rigid manner to the seat support, the seat or the frame of the chair. The seat support-backrest support combination created in this manner is pivotable backward by means of the tilt mechanism about a pivot axis which extends transversely with respect to the longitudinal direction of the chair when the user of the chair leans against the backrest. These types of tilt mechanisms are often used in place of synchronous mechanisms in inexpensive visitor or conference chairs in order to provide them with a simple tilt function. On account of their comparatively simple design, tilt mechanisms are clearly more cost-effective to produce in the majority of cases than the synchronous mechanisms previously described.

BRIEF SUMMARY OF THE INVENTION

An object of the invention is to provide an office chair which has a mechanism which is particularly simply designed structurally and is consequently comparatively inexpensive but nevertheless extremely variable.

Said object is achieved by a mechanism as claimed or by an office chair as claimed. Advantageous realizations of the invention are provided in the sub-claims.

A core idea of the invention is to provide a common pivot axis for the coupling between the seat support and the backrest support of the office chair.

Said common pivot axis, in this case, is preferably the only pivot axis common to the seat support and the backrest support, i.e. there is no further pivot axis that connects the seat support and the backrest support together.

Said pivot axis is preferably the only pivot axis of the seat support and at the same time the only pivot axis of the backrest support.

The common pivot axis is preferably the only pivot axis of said mechanism altogether, in particular the only pivot axis which makes it possible for the mechanism components, such as the seat support or the backrest support, to pivot forward and/or backward in the longitudinal direction of the chair. In other words then, the entire mechanism only comprises one such pivot axis, namely the common pivot axis.

As a result of said idea of the common pivot axis, the mechanism is designed in a particularly simple manner and can be produced inexpensively, but at the same is extremely variable, as is shown by the following explanations.

The seat support and the backrest support are connected, preferably exclusively, to the base support by means of one or several common pivot bolts, in this case realizing the above-described, preferably only common pivot axis. This means that the at least one common pivot bolt rotatably mounts both the seat support and the backrest support.

More precisely, according to the invention, by realizing said common pivot axis the seat support is connected in an articulated manner to the base support by means of at least one pivot bolt and is pivotable relative to the base support. The seat support is preferably connected in an articulated manner to the base support and also to the backrest support exclusively by means of said at least one pivot bolt and is pivotable relative to the base support and relative to the backrest support independently of the backrest support pivoting or being acted upon.

According to the invention, over and above this, by realizing said common pivot axis the backrest support is connected in an articulated manner to the base support by means of at the least one pivot bolt and is pivotable relative to the base support. The backrest support is preferably connected in an articulated manner to the base support and also to the seat support exclusively by means said at least one pivot bolt and is pivotable relative to the base support and relative to the seat support independently of the seat support pivoting or being acted upon.

Both components of the office chair that can be acted upon with forces when the office chair is in use, namely the seat support and the backrest support, are consequently pivotable individually and independently of one another. Depending on the further special realization of the mechanism, different dependencies between the movements of the seat support and the backrest support can be defined. The common pivot axis, in this case, makes particularly simple handling and adjustment possible.

The pivot bolt or bolts used, in this case, always fulfill a dual function. On the one hand, they serve for pivotally mounting the seat support on the base support and, on the other hand, for pivotally mounting the backrest support on the base support. As a result, the pivot bolt serves at the same time for connecting the backrest support and the seat support. The pivot bolt is preferably connected in a rigid manner to the base support and can consequently be seen as part of the base support. A particularly simple structural realization is achieved when simply one single pivot bolt is used which, for example, proceeding from the center of the base support, extends outward on both sides transversely with respect to the longitudinal direction of the chair.

In summary, the invention provides a particularly variable office chair mechanism, in particular a tilt or pivot mechanism, which makes it possible for the backrest to pivot individually independently of the degree of pivoting of the sitting surface. At the same time, the simple design of the mechanism described up to now enables the particularly simple use of further components by way of which the movement characteristic of the mechanism is modifiable in a variable manner. In other words, on the basis of one single basic structure, different mechanisms with pivoting characteristics that are clearly different from one another are able to be produced by means of the simplest modifications.

In preferred embodiments, the pivoting properties of the individual components are adjustable by means of resilient damping elements. Depending on whether the resilience of said damping elements is chosen to be the same as or different from one another, different pivot characteristics, in particular different pivot resistances and resetting forces for the seat support and the backrest support, are able to be set. At the same time, the different positioning of the damping elements inside the mechanism, more precisely the different positioning of the damping elements between the mechanism components and consequently the choice as to which of said mechanism components serves as the impinging element and which as the abutment, makes it possible to set different movement characteristics. The mechanism according to the invention, in this case, is able to replicate, for example, the movement characteristics of a synchronous mechanism without a costly mechanical structure being necessary for this purpose.

In a preferred embodiment of the invention, the mechanism comprises at least one first resilient damping element which is acted upon when the seat support is pivoted. In particular, said first resilient damping element is acted upon by the seat support when the seat support is pivoted forward or backward in the longitudinal direction of the chair. The seat support, which is mounted on the central pivot axis, can consequently be pivoted backward or forward against the resistance of the first resilient damping element for example when the user shifts his weight.

If, in this case, as in a particularly preferred embodiment of the invention, the at least one first resilient damping element is arranged between the base support and the seat support, in other words therefore if the base support forms the abutment for the at least one first resilient damping element which is acted upon by the seat support, the damping or the resetting of a pivoting movement of the seat support relative to the base support and also the pivot range of the seat support can be adjusted individually and—depending on the further structural development of the mechanism—independently of an impingement of the backrest support or, however, in dependence on such an impingement of the backrest support, i.e. on the backrest pivoting.

In a preferred embodiment of the invention, the mechanism comprises at least one second resilient damping element which is acted upon when the backrest support is pivoted. Said second resilient damping element is acted upon by the backrest support in particular when the backrest support is pivoted in the longitudinal direction of the chair.

In a preferred embodiment of the invention according to claim 4, the mechanism comprises at least one second resilient damping element which is acted upon when the backrest support is pivoted. Said second resilient damping element is acted upon by the backrest support in particular when the backrest support is pivoted in the longitudinal direction of the chair.

The arrangement of said second resilient damping element determines then whether it is a mechanism where the seat support and the backrest support are coupled closely together, where a movement of the one component brings about a subsequent movement of the other component, or whether the seat support and the backrest support are more or less completely uncoupled from one another such that there are two pivoting movements which are independent of one another.

In a preferred embodiment of the invention, the at least one second resilient damping element is arranged between the backrest support on the one hand and the seat support on the other. In other words, the seat support forms the abutment for the at least one second resilient damping element which is acted upon by the backrest support.

In a special embodiment of such a coupled variant, pivoting the seat support, as is preferably effected against the at least one first resilient damping element, results in a subsequent movement of the backrest support, i.e. the backrest support follows the pivoting movement of the seat support without the at least one second resilient damping element needing to be acted upon by the backrest support and the seat support for this purpose.

In a special embodiment of such a coupled variant, over and above this, pivoting the backrest support, as is preferably effected against the at least one second resilient damping element, results in a subsequent movement of the seat support, in particular in a subsequent movement of the seat support against the at least one first resilient damping element. In other words, the seat support follows the pivoting movement of the backrest support. In this case, the seat support is entrained by means of the second resilient damping element as the seat support and the backrest support are operatively connected to one another by means of said damping element.

In another preferred embodiment of the invention, the at least one second resilient damping element is arranged between the backrest support on the one hand and the base support on the other hand. In other words, the base support forms the abutment for the at least one second resilient damping element which is acted upon by the backrest support.

In such an uncoupled variant no subsequent movements, as described above, take place. The seat support and the backrest support are completely decoupled from one another with regard to their pivoting movements.

It is advantageous in all the above-described cases when the first resilient damping element comprises a resilience which differs from the resilience of the second resilient damping element. In other words, the resilience of the said damping elements can be predetermined as a result of choosing the damping elements in a suitable manner, in particular by choosing the material in a suitable manner. As a result, the pivot properties of the seat support or of the backrest support are adjustable in a defined manner, on the one hand respectively for the relevant mechanism components per se, and on the other hand matched to one another, for example for providing a movement characteristic which recreates that of a synchronous mechanism.

For example, choosing the damping elements in a suitable manner can ensure that the backrest support performs at least the same pivot angle as the seat support. As an alternative to this, for example, the hardness of the damping elements can be adjusted so as to match one another in such a manner that when the user shifts his weight backward the pivot angle of the backrest support is greater than the pivot angle of the seat support. An additional deflection angle of the backrest support is added to the deflection angle of the seat support such that a synchronous effect is experienced.

On account of the characteristics of the structural design of the mechanism according to the invention, in particular the common single pivot axis, a multistage locking arrangement for the displacement movements of the seat support and/or the backrest support can be realized with particularly simple means, in particular by way of such produced by a linear displacement movement of a blocking element. For this purpose, the base support, seat support and backrest support preferably comprise openings which are aligned with one another for receiving the blocking element.

BRIEF DESCRIPTION OF THE SEVERAL VIEWS OF THE DRAWING

The invention is further explained in the figures of the drawing by way of exemplary embodiments, in which figures.

DESCRIPTION OF THE INVENTION

Figure 1:
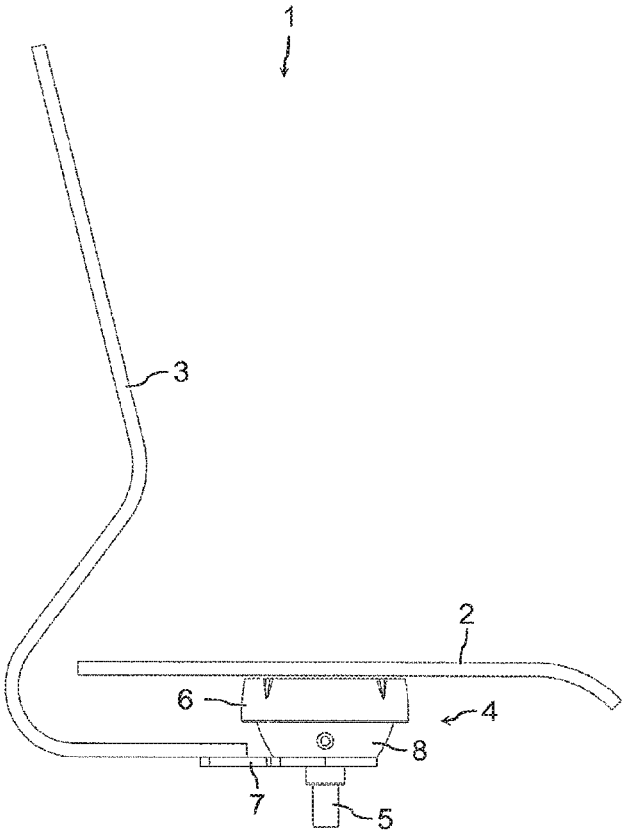
FIG. 1 shows an office swivel chair shown in part having a support structure for a sitting surface and a backrest of an office swivel chair.
Figure 2:
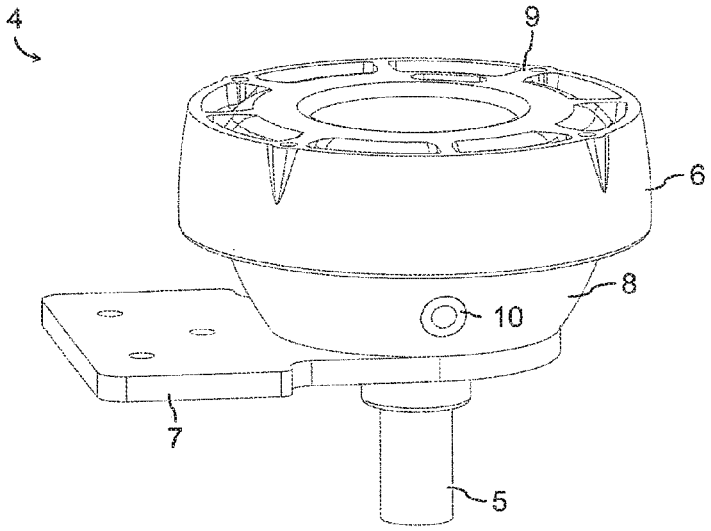
FIG. 2 shows a perspective view of the support structure from FIG. 1.
Figure 3:
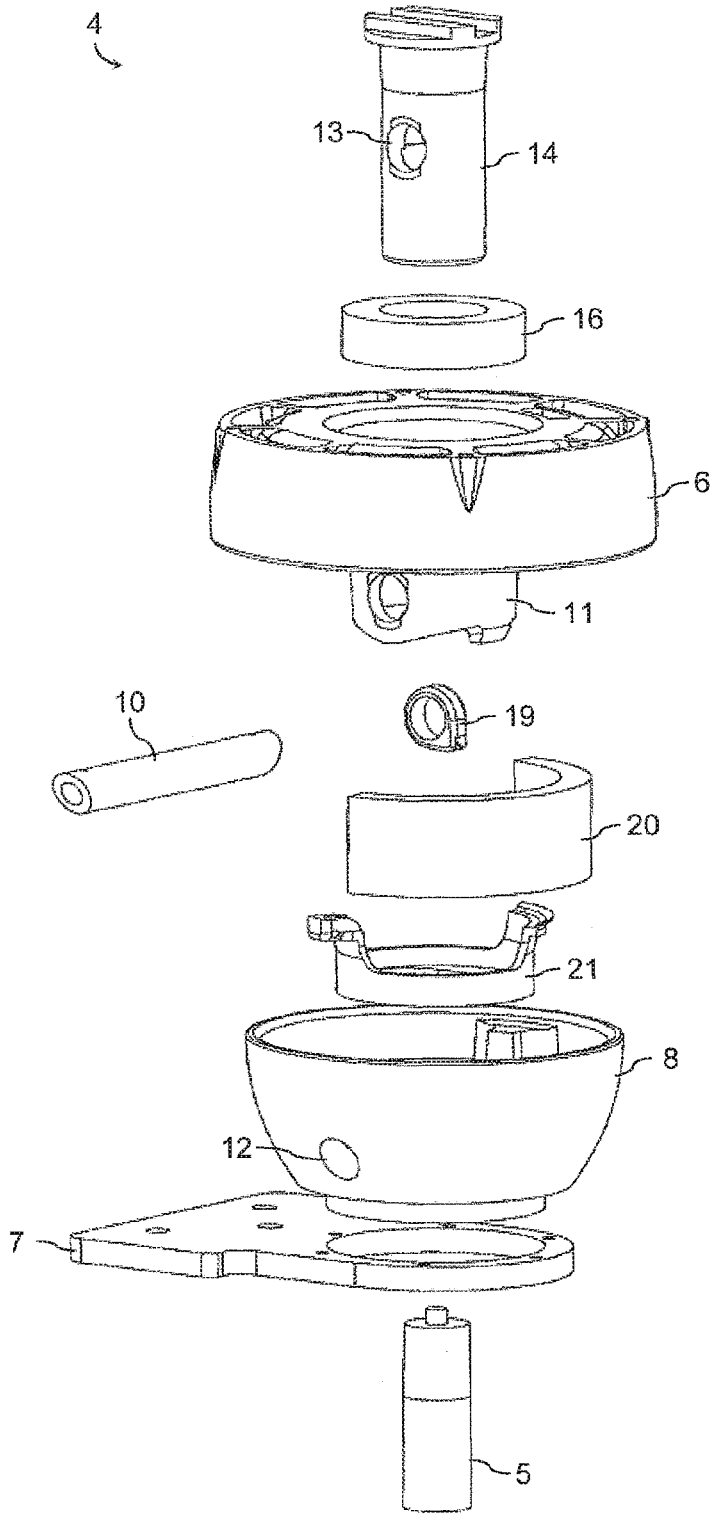
FIG. 3 shows an exploded drawing of the support structure from FIG. 2.

None of the figures show the invention true to scale, in this case they are simply shown schematically and just with their essential components.

Identical references in this case correspond to elements with the identical or comparable function.

First embodiments of the chair mechanism are explained below by way of FIGS. 1 to 7. First of all, said embodiments will be explained in general. In this connection, the mechanism is designated as a "support structure".

The support structure according to the invention for a sitting surface and a backrest of an office swivel chair comprises a sleeve-shaped seat base, a hollow-cylindrical back base, a pivot bolt and a resilient damping element. The seat base has an end face for fastening the sitting surface and an inside lateral surface. The back base is arranged coaxially with respect to the seat base. In addition, a backrest adapter is realized on the back base for fastening the backrest. The pivot bolt comprises a longitudinal axis which extends in the radial direction of the seat base and is mounted in a bearing block of the seat base and in bearing bushes which are realized in the lateral surface of the back base. The resilient damping element is arranged between the end face of the seat base and the end face of the back base at least in the region which is located opposite the backrest adapter when viewed in the radial direction.

As a result of the bearing arrangement in the pivot bolt, the seat base and the back base—and consequently the sitting surface and the backrest which are connectable thereto—are pivotable relative to one another. The resilient damping element serves for damping and resetting said pivoting movement into the initial position. All in all, the backrest is consequently able to be pivoted individually independently of the degree of pivoting of the sitting surface.

The resilient damping element can be realized as a ring-shaped element and can be realized extensively in the region between the end face of the seat base and the end face of the back base. However, it is enough for the damping element to be realized between the end face of the seat base and the end face of the back base in the region which is located opposite the backrest adapter when seen in the radial direction. A saving in material is possible in this way compared to the realization as a solid ring. Realizing the resilient damping element as a semicircular ring segment has proved to be particularly advantageous.

In an advantageous embodiment, the support structure additionally comprises a hollow-cylindrical gas spring base, which is arranged coaxially with respect to the seat base, for receiving a gas spring. The gas spring base, in this connection, is mounted on the inside lateral surface of the seat base with the interposition of a resilient ring element. As a result of the resilient ring element, the seat base—and consequently the sitting surface—is resiliently mounted relative to the gas spring base. The sitting surface can consequently be pivoted/tilted relative to the chair column. In other words, an office swivel chair which has both a pivotable backrest and a pivotable sitting surface is obtained. The pivoting movement of the backrest and of the sitting surface are independent of one another in this connection.

By choosing the resilience of the resilient damping element and of the resilient ring element, it is possible to adapt the intensity of the pivoting movement or of the pivoting range of the backrest and/or of the sitting surface. It has proved to be particularly advantageous in this connection to provide the resilient ring element with less resilience than the resilient damping element. The adjusting of the resilience can be effected, for example, by choosing suitable materials for the resilient damping element and the resilient ring element.

In an advantageous manner, the pivot bolt is additionally mounted in bearing bushes which are realized in the lateral surface of the gas spring base. As a result, the pivot bolt serves for pivotably mounting both the seat base relative to the back base and the gas spring base relative to the seat base. Consequently, the pivot bolt fulfills a dual function.

In an advantageous embodiment, the bearing bushes of the gas spring base, in which the pivot bolt is mounted, are provided with rubber rings. In other words, the pivot bolt is mounted in the bearing bushes of the gas spring base with the rubber rings interposed. As a result of the resilience properties of the rubber rings, the pivot bolt is provided with a resilient (flexible) bearing arrangement. An additional side inclination of the sitting surface can be achieved in this way.

In a further advantageous embodiment, a gas spring height adjustment ring is mounted on the pivot bolt. In this way, the pivot bolt serves for adjusting the height of the sitting surface at the same time. The functionality of the pivot bolt is consequently increased further.

In a further advantageous embodiment, the support structure additionally comprises a back-locking element, which is arranged between the seat base and the back base and is rotatable in the circumferential direction of the seat base, for locking and unlocking the pivoting movement of the seat base relative to the back base. The relative movement between the seat base and the back base can be suppressed in this manner where necessary by the user of the office swivel chair. In the locked position, the back rest and the sitting surface are pivoted together on the basis of the pivoting movement permitted by the resilient ring element.

The office swivel chair according to the invention comprises a pedestal having a gas spring which serves as the chair column, one of the support structures described above, a sitting surface which is connected to the seat base and a backrest which is connected to the backrest adapter.

The first embodiments of the invention shown in FIG. 1 to 7 are described in detail below with reference to said drawings.

FIG. 1 shows an office swivel chair 1 with a sitting surface 2 and a backrest 3. The sitting surface 2 and the backrest 3 are connected together by means of a support structure 4. More precisely, the sitting surface 2 is fastened on a seat base 6 of the support structure 4. The backrest 3 is connected to a back base 8 by means of a backrest adapter 7.

In addition, the support structure 4 serves for receiving a top end region of a gas spring 5 (only shown in a reduced form in FIG. 1). The gas spring 5 forms the so-called chair column. The bottom region of the chair column and the pedestal of the office swivel chair 1 are not shown in FIG. 1.

FIG. 2 to FIG. 6 show details of the support structure 4. The seat base 6 is realized in a substantially sleeve-shaped manner. The sitting surface 2 is mounted on the end face 9 of the seat base 6. The back base 8 is arranged coaxially with respect to the seat base 6. The back base 8 is formed in a substantially hollow-cylindrical manner, the outside diameter of the lateral surface widening from bottom to top. A bearing bolt 10 extends in the radial direction and is mounted in a bearing block 11 of the seat base 6 and in bearing bushes 12 of the back base 8. At the same time, the bearing bolt 10 is mounted in bearing bushes 13 of a gas spring base 14.

The gas spring base 14 is arranged inside the seat base 6 and is aligned coaxially with respect to said seat base. The gas spring base 14 is realized in a substantially hollow-cylindrical manner and receives the top end region of the gas spring 5. A resilient ring element 16 is arranged between the outside lateral surface of the gas spring base 14 and the inside lateral surface 15 of the seat base 6. Said ring element 16 is mounted in the axial direction between a shoulder 17 on the inside lateral surface 15 of the seat base 6 and a flange 18 which is realized on the end face of the gas spring base 14. In addition, a gas spring height adjustment ring 19 is mounted on the bearing bolt 10 inside the gas spring base 14. As a result of rotating the bearing bolt 10, the height of the gas spring 5 and consequently the height of the sitting surface 2 is adjusted.

A resilient damping element 20 is arranged between the end face of the seat base 6 and the end face of the back base 8. The resilient damping element 20 is realized as a semi-circular ring segment and is arranged in the region between the end face of the seat base 6 and the end face of the back base 8 which is located opposite the backrest adapter 7 when seen in the radial direction. The resilient ring element 16 has less resilience than the resilient damping element 20.

A back-locking element 21 is also arranged coaxially with respect to the seat base 6. The back-locking element 21 is rotatable in the circumferential direction of the seat base 6 and serves for locking and unlocking the pivoting movement of the seat base 6 relative to the back base 8 about the pivot bolt 10.

In the unlocked position of the back-locking element 21, the seat base 6 is able to pivot relative to the back base 8 around the pivot bolt 10—and consequently the sitting surface 2 is able to pivot relative to the backrest 3. At the same time, the seat base 6 is able to pivot relative to the gas spring base 14 around the pivot bolt 10—and consequently the sitting surface 2 is able to pivot relative to the chair column. In this connection, the relative movement of the seat base 6 with respect to the back base 8 originates from the resilient damping element 20, whilst the relative movement of the seat base 6 with respect to the gas spring base 14 is made possible by the resilient ring element 16.

Figure 4:
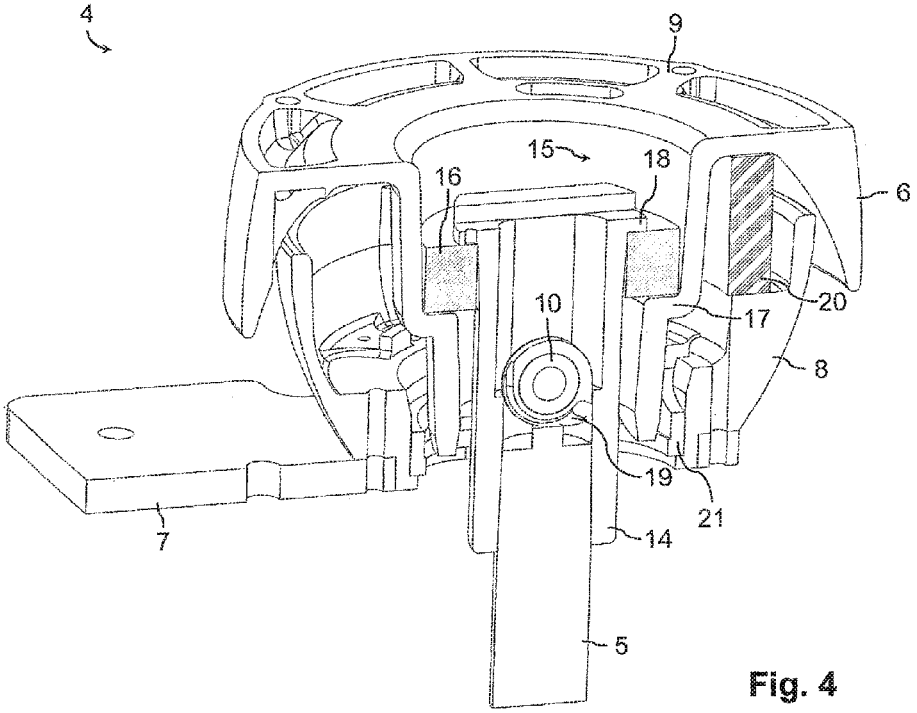
FIG. 4 shows a perspective sectional view of the support structure from FIG. 2 in an upright initial position.
Figure 5:
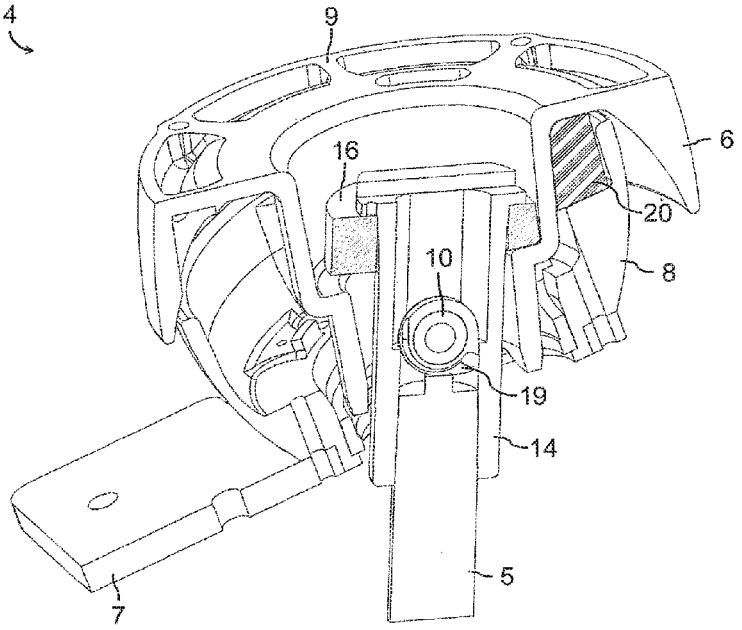
FIG. 5 shows a perspective sectional view of the support structure from FIG. 2 in a pivot position.
Figure 6:
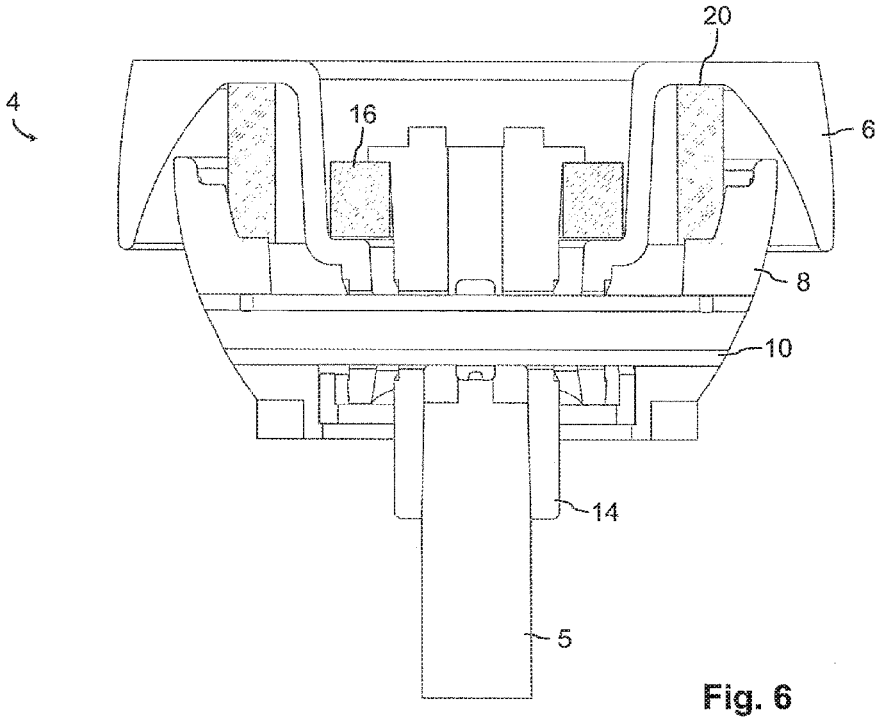
FIG. 6 shows a further sectional view of the support structure from FIG. 2.

FIG. 4 shows the support structure 4 in the initial upright position, whilst FIG. 5 shows the support structure 4 in a backwardly pivoted position. In the pivot position, the resilient damping element 20 and the resilient ring element 16 are compressed along the region located opposite the backrest adapter 7 when viewed in the radial direction.

As a result of the various degrees of resilience of the resilient damping element 20 and of the resilient ring element 16 as well as the various lever arms realized opposite the pivot bolt 10, the seat base 6 is deflected less strongly out of the initial position than the back base 8. Consequently, it is possible to pivot the seat base 6 and the back base 8 independently.

Figure 7:
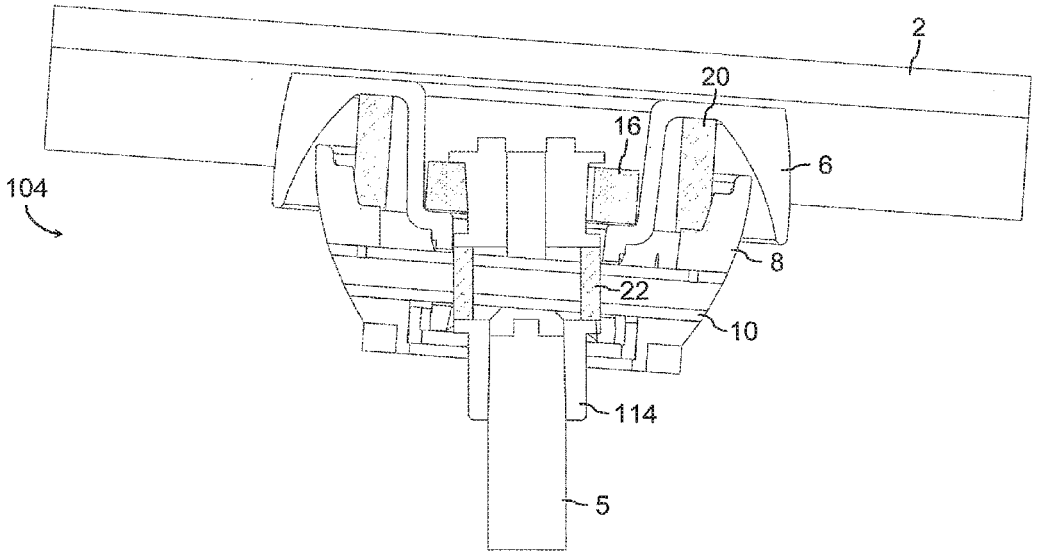
FIG. 7 shows a sectional view of a further embodiment.

FIG. 7 shows a further embodiment of a support structure 104. The support structure 104 differs from the above-described support structure simply in the realization of the gas spring base. The remaining components remain unchanged.

The design of the gas spring base 114 used in the support structure 104 corresponds substantially to that of the gas spring base 14 and differs from the gas spring base 14 by rubber rings 22 which are additionally present. Said rubber rings 22 are mounted in the bearing bushes 13 of the gas spring base 114. The pivot bolt 10 is consequently mounted in the bearing bushes 13 of the gas spring base 114 with the interposition of the rubber rings 22. As a result of the resilience properties of the rubber rings 22, the pivot bolt 10 is resiliently mounted inside the gas spring base 114. This, in turn,—when the user shifts his weight or changes his position—leads to a side of the sitting surface 2 tilting.

The invention is consequently focused on a support structure 4, 104 for a sitting surface 2 and a backrest 3 of an office swivel chair 1, comprising: a sleeve-shaped seat base 6 having an end face 9 for fastening the sitting surface 2 and an inside lateral surface 15; a hollow-cylindrical back base 8 which is arranged coaxially to the seat base 6 and on which a backrest adapter 7 is realized for fastening the backrest 3; a pivot bolt 10 which comprises a longitudinal axis that extends in the radial direction of the seat base 6 and which is mounted in a bearing block 11 of the seat base 6 as well as in bearing bushes 12 realized in the lateral surface of the back base 8; and a resilient damping element 20 which is arranged between the end face of the seat base 6 and the end face of the back base 8 at least on the region which is located opposite the backrest adapter 7 when seen in the radial direction. The invention is additionally focused on such a support structure wherein the resilient damping element 20 is realized as a semicircular ring segment. The invention is additionally focused on such a support structure, additionally comprising a hollow-cylindrical gas spring base 14, 114, which is arranged coaxially with respect to the seat base 6, for receiving a gas spring 5, the gas spring base 14, 114 being mounted on the inside lateral surface 15 of the seat base 6 with interposition of a resilient ring element 16. The invention is additionally focused on such a support structure wherein the resilient ring segment 16 is mounted in the axial direction between a shoulder 17 of the inside lateral surface 15 of the seat base 6 and a flange 18 which is realized on the end face of the gas spring base 14, 114. The invention is additionally focused on such a support structure wherein the resilient ring element 16 comprises less resilience than resilient damping element 20. The invention is additionally focused on such a support structure wherein the pivot bolt 10 is additionally mounted in bearing bushes 13 which are realized in the lateral surface of the gas spring base 14, 114. The invention is additionally focused on such a support structure wherein rubber rings 22, in which the pivot bolt 10 is mounted, are introduced in the bearing bushes 13 of the gas spring base. The invention is additionally focused on such a support structure according to one of the preceding claims, wherein a gas spring height adjustment ring 19 is mounted on the pivot bolt 10. The invention is additionally focused on such a support structure according to one of the preceding claims additionally comprising a back-locking element 21, which is arranged between the seat base 6 and the back base 8 and is rotatable in the circumferential direction of the seat base 6, for locking and unlocking the pivoting movement of the seat base 6 relative to the back base 8 about the pivot bolt 10. Finally, the invention is also additionally focused on an office swivel chair 1, comprising: a pedestal having a gas spring 5 which serves as a chair column; a support structure 4, 104 according to one of the preceding claims; a sitting surface 2 which is connected to the seat base 6; and a backrest 3 which is connected to the backrest adapter 7.

Second embodiments of the chair mechanism are explained below by way of FIG. 8 to 26. In this case, four different types of mechanism are described which have been designated with the letters A to D to make differentiation easier.

FIG. 8 to 13 show an "A" type mechanism 4A.

The pivoting mechanism comprises a base support 14 which is placed onto the top end of a chair column (not shown) by means of a tapered receiving means. Over and above this, the mechanism comprises a seat support 6 and a backrest support 8, which is forked when seen in top view and the cheeks 23 of which are arranged on both sides of the base support 14. The seat support 6 is provided for receiving or mounting an upholstered sitting surface (not shown). An indicated backrest 3, which is height-adjustable in the case of modern office chairs, is mounted on the backrest support 8. The backrest 3 can also be integrally connected to the backrest support 8.

The entire "A-type" mechanism 4A—just as the "B-type", "C-type" and "D-type" mechanisms described below—is designed in a mirror-symmetrical manner, with reference to a center longitudinal plane, which relates to the actual kinematics. In this respect, the following description always assumes structural elements that are present in pairs on both sides.

Figure 8:
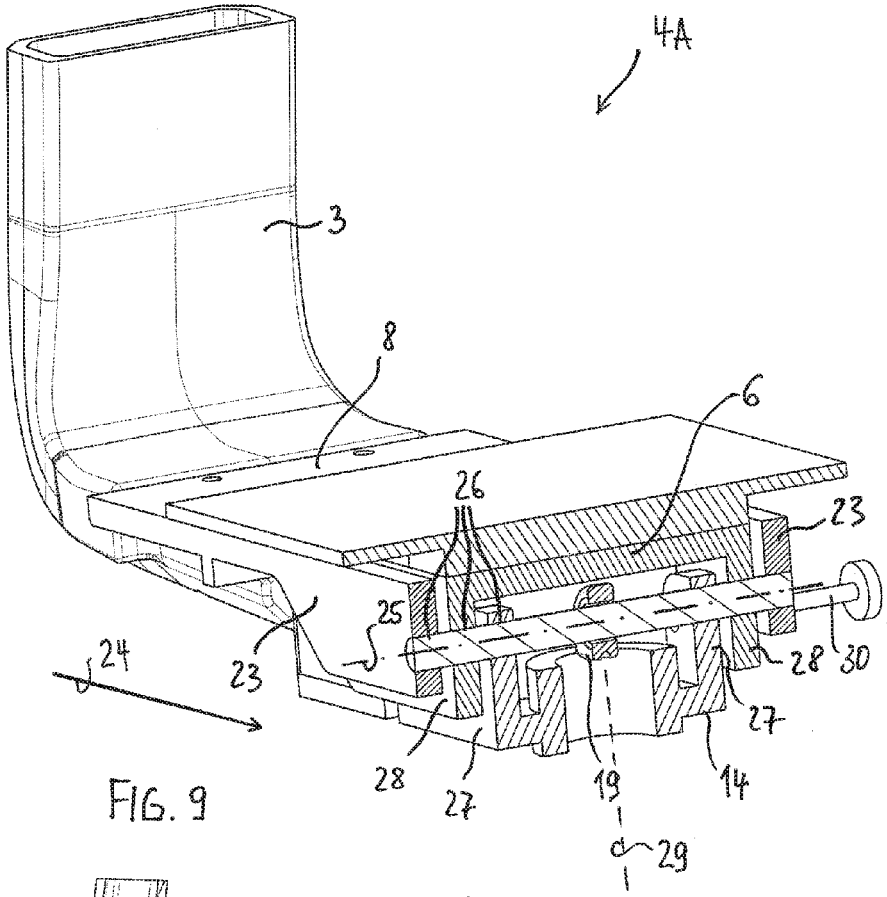
FIG. 8 shows a perspective sectional view of an "A-type" mechanism.
Figure 9:
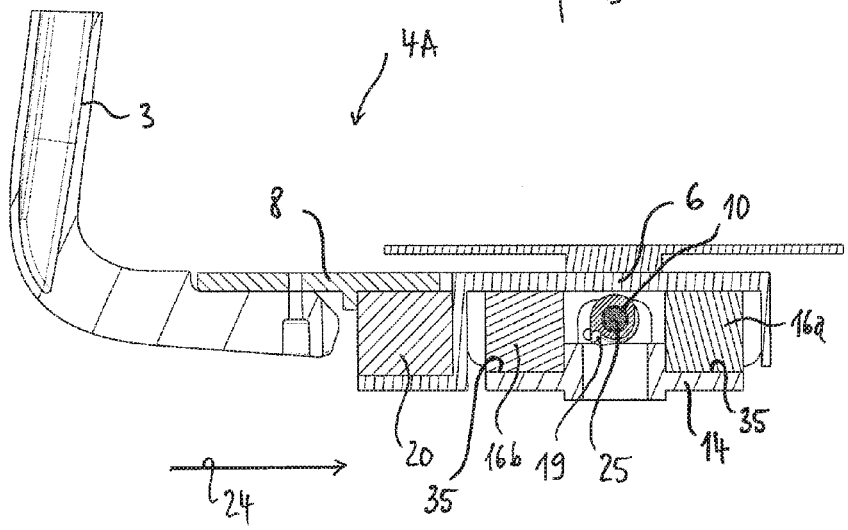
FIG. 9 shows a sectional view of the mechanism from FIG. 8 in the non-pivoted initial state.

FIGS. 8 and 9 show the initial position where the backrest support 8 assumes a substantially horizontal position and the seat support 6 has been pivoted neither forward nor backward in the longitudinal direction 24 of the chair. The mechanism 4A is designed in a comparatively compact manner by the central base support 14 being encompassed at least laterally both by the seat support 6 and the cheeks 23 of the backrest support 8.

By realizing a common pivot axis 25 which extends transversely to the longitudinal direction 24 of the chair, on one hand the seat support 6 is connected in an articulated manner to the base support 14 by means of one single continuous pivot bolt 10 and is pivotable forward and backward in the longitudinal direction 24 of the chair relative to the base support 14 and, on the other hand, the backrest support 8 is connected in an articulated manner to the base support 14 by means of said pivot bolt 10 and is pivotable relative to the base support 14 from its non-pivoted initial state into a pivot state in which it is pivoted down and back. The pivot bolt 10, in this case, is mounted in bearing bushes 26 or the like, see FIG. 8, which are provided for this purpose in the cheeks 23 of the backrest support 8, in the side walls 28 of the seat support 6 which flank the side walls 27 of the base carrier 14 as well as in the side walls 27 of the base support 14 itself. If a base support 14 without side walls is used, corresponding bearings 26 can also be provided in an upwardly elongated tapered receiving means or in a gas spring base. The common pivot axis 25, in this case, extends centrally over the tapered receiving means such that the horizontal pivot axis 25 and the vertical center longitudinal axis 29 of the chair column intersect, see FIGS. 8 and 13.

A front first resilient damping element 16*a*, which when the seat support 6 is pivoted forward in the longitudinal direction 24 of the chair is acted upon by the seat support 6, is provided in front of the tapered receiving means when viewed in the longitudinal direction 24 of the chair. A rear first resilient damping element 16*b*, which when the seat support 6 is pivoted backward in the longitudinal direction 24 of the chair is acted upon by the seat support 6, is provided behind the tapered receiving means when viewed in the longitudinal direction 24 of the chair.

Both the front first resilient damping element 16*a* and the rear first resilient damping element 16*b* are arranged between the base support 14 and the seat support 6. The base support 14 consequently forms the abutment for both damping elements 16*a*, 16*b*.

The backrest support 8 is connected to the seat support 6 exclusively by means of the pivot bolt 10 and by means of a central second damping element 20 which is arranged behind the tapered receiving means. Said second resilient damping element 20 is acted upon by the backrest support 8 when the backrest support 8 is pivoted back and down in the longitudinal direction 24 of the chair. In order to achieve this, the second damping element 20 is arranged between the backrest support 8 on the one hand and the seat support 6 on the other hand such that the seat support 6 forms the abutment for the second resilient damping element 20 which is acted upon by the backrest support 8.

Figure 10:
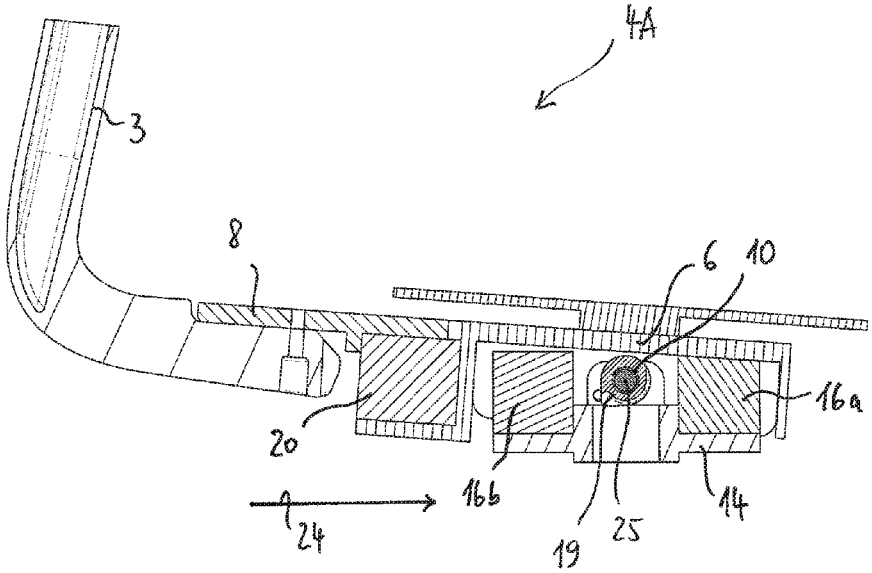
FIG. 10 shows a sectional view of the mechanism from FIG. 8 with the seat support pivoted forward.

When the seat support 6 pivots forward in the longitudinal direction 24 of the chair out of the initial state shown in FIG. 8 and FIG. 9, the front first damping element 16*a* is acted upon, see FIG. 10. As the backrest support 8 is connected to the seat support 6 by means of the second damping element 20, the backrest support 8 follows the forward movement of the seat support 6 insofar as the backrest support 8 is not loaded by a user leaning against it and as a result is prevented from a subsequent movement.

Figure 11:
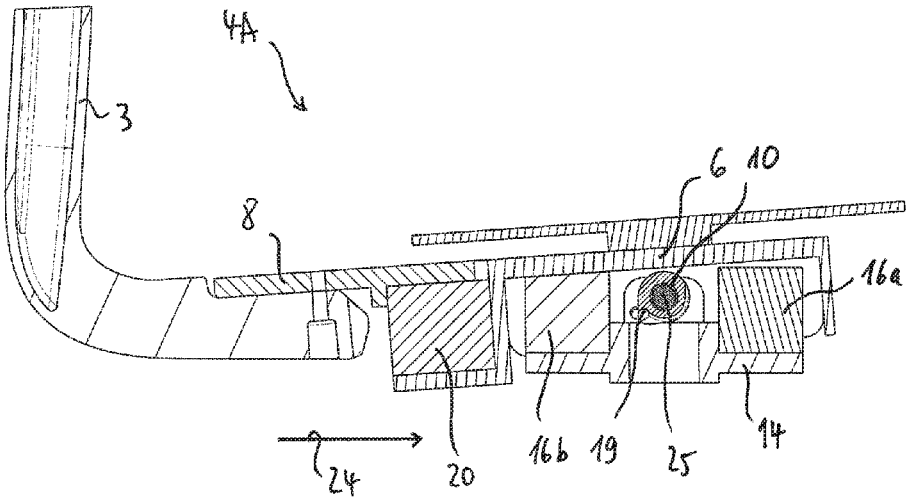
FIG. 11 shows a sectional view of the mechanism from FIG. 8 with the seat support pivoted backward.

When the seat support 6 pivots backward in the longitudinal direction 24 of the chair, the rear first damping element 16*b* is acted upon, see FIG. 11. As at the same time the seat support 6 supports the second damping element 20, by means of which the backrest support 8 is connected to the seat support 6, the tilting of the seat support 6 is followed by corresponding tilting of the backrest support 8 and consequently of the backrest 3, shown once again in FIG. 11 for the case where the backrest 3 itself is not acted upon.

Figure 12:
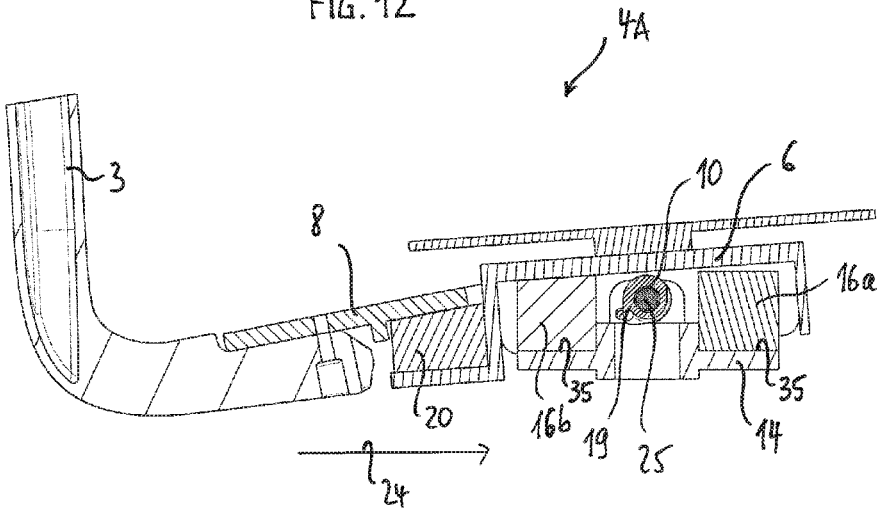
FIG. 12 shows a sectional view of the mechanism from FIG. 8 with the backrest support pivoted backward.

If, as shown in FIG. 12, the backrest 3 is loaded by a chair user leaning against it and consequently the backrest support 8 is acted upon, the backrest support 8 then acts upon the second damping element 20. As the second damping element 20 is supported by the seat support 6, the impingement of the second damping element 20 by the backrest support 8 brings about—in dependence on the resilience, more precisely in dependence on the deformation resistance of the second damping element 20 and on the deformation resistance of the rear first damping element 16*b* countering said movement—a more or less strong subsequent movement of the seat support 6 in the same direction, here therefore downward. A typical synchronous movement, that is to say the seat support 6 tilting to the back when the backrest 3 pivots, is consequently achieved without a costly synchronous mechanism being necessary for this purpose. The desired pivoting characteristic of the office chair 1 is able to be adjusted as a result of selecting the material for the damping elements 16, 20 in a suitable manner.

Figure 13:
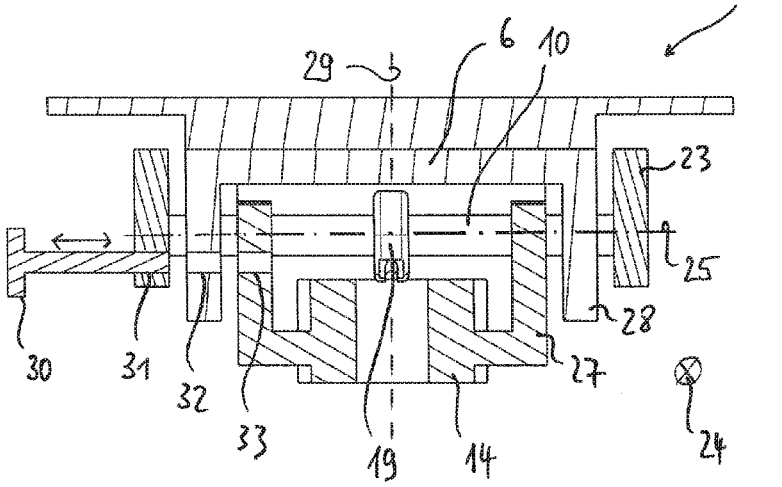
FIG. 13 shows another sectional view of the mechanism from FIG. 8 looking at a multistage locking arrangement.

FIG. 13 shows a further cross section through the mechanism 4A, from which it can be seen how simply a multistage locking arrangement for the pivoting movements of the seat support 6 and/or the backrest support 8 can be realized by means of a linear displacement of a blocking element 30. The, for example, rod-shaped blocking element 30 can be placed for this purpose selectively into one or several openings 31, 32, 33 which are aligned with one another and are provided in the base support 14, the seat support 6 and the backrest support 8 for receiving the blocking element 30. In the first locking stage shown in FIG. 13, where the blocking element 30 is simply inserted in the outer receiving opening 31 of the backrest support 8, the locking arrangement is released. If the blocking element 30 is pushed further into the mechanism 4A in the direction of the tapered receiving means such that it is inserted in the next receiving opening 32 of the seat support 6, the second locking stage is achieved in which movement of the seat support 6 relative to the backrest support 8 is blocked. In this case, the seat support/backrest support combination 6, 8 can only still be tilted as one common pivot unit, as a result of which the pivoting principle of a tilt mechanism is realized. In the final third locking stage, which is achieved when the blocking element 30 is also pushed into the next receiving opening 33 of the base support 14 and is inserted within the same, in addition to the blocking action of the second locking stage the seat support/backrest support combination 6, 8 is also blocked from pivoting relative to the base support 14; this corresponds to a locked tilt mechanism.

The multistage locking arrangement, as illustrated in FIG. 13, can also be used in the "B-type", "C-type" and "D-type" mechanisms described below.

In contrast to the "A-type" mechanism 4A shown in FIG. 8 to 13, where there is a coupling between the seat support 6 and the backrest support 8 by means of the second damping element 20 which is supported by the seat support 6, the "B-type" mechanism described below in conjunction with FIG. 14 to 20 does not comprise any such coupling.

In contrast to the "A-type" mechanism, the second resilient damping element 20 is arranged here between the backrest support 8 on the one hand and the base support 14 on the other. In other words, the base support 14 forms the abutment for the second resilient damping element 20 which is acted upon by the backrest support 8 when pivoting.

Figure 14:
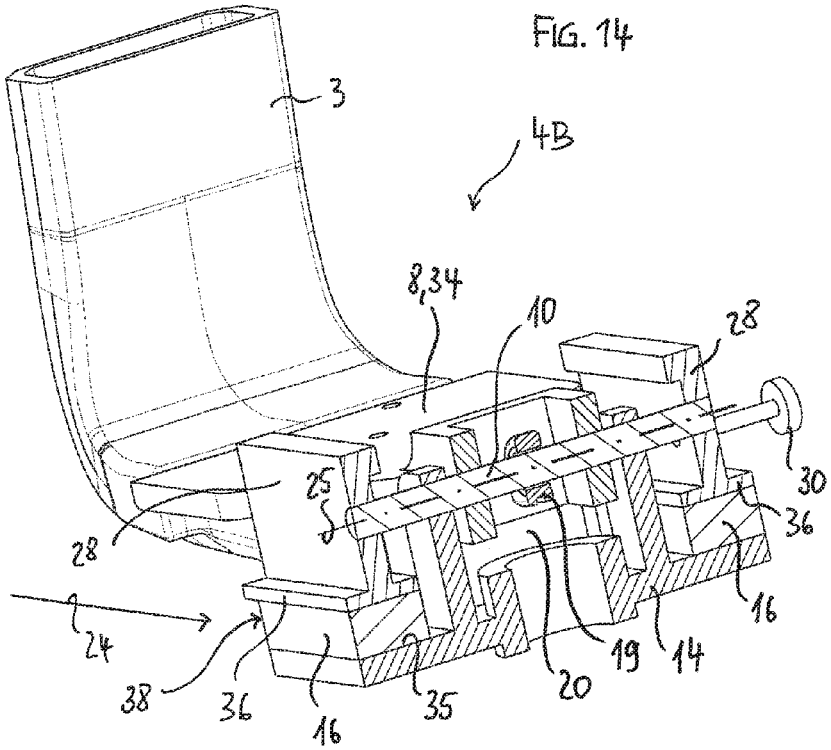
FIG. 14 shows a perspective sectional view of a "B-type" mechanism from the front.
Figure 15:
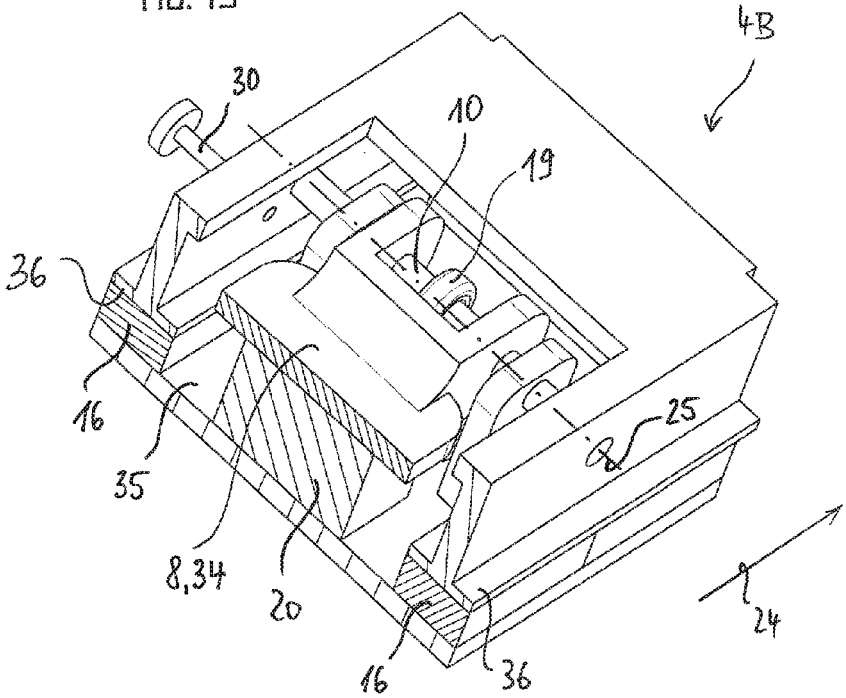
FIG. 15 shows a sectional view, in perspective, of the mechanism from FIG. 14 from behind.
Figure 16:
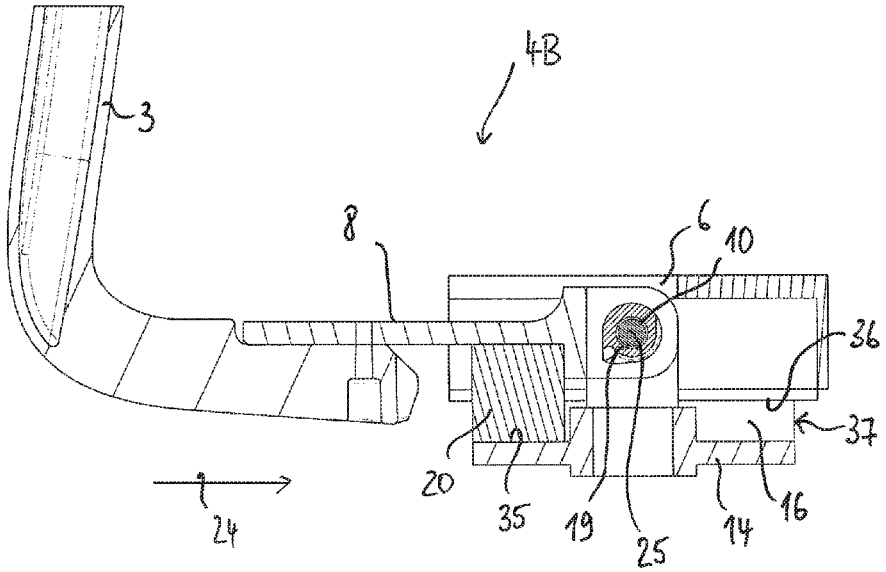
FIG. 16 shows a sectional view of the mechanism from FIG. 14 in the non-pivoted initial position.

FIGS. 14 and 15 show the sectioned mechanism 4B from the front and from the rear such that the arrangement of the damping elements 16, 20 becomes particularly explicit. In said case, the outside side walls 28 of the seat support 6 encompass the inside central backrest support element 34 of the backrest support 8, which, in this case, does not comprise any cheeks. The second damping element 20 is situated between said backrest support 8 on the one hand and a base plate 35 of the base support 14 on the other hand, see FIG. 15. Provided on both sides between the side walls 28 of the seat support 6, which for this purpose comprise downwardly pointing, stamp-shaped ends 36, and the base plate 35 of the seat support 6 are first damping elements 16 which extend continuously from front to back over the entire length of the base support 14. Both the first damping elements 16 and the second damping elements 20 consequently rest on the same structural element which serves as abutment, the base plate 35 of the base support 14. The non-pivoted initial state is shown again in FIG. 16.

Figure 17:
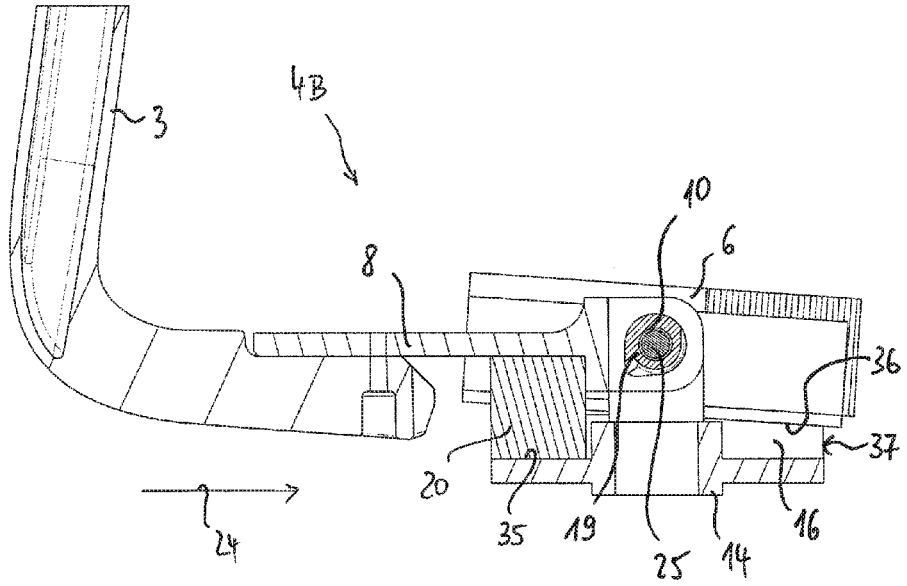
FIG. 17 shows a sectional view of the mechanism from FIG. 14 with the seat support pivoted forward.
Figure 18:
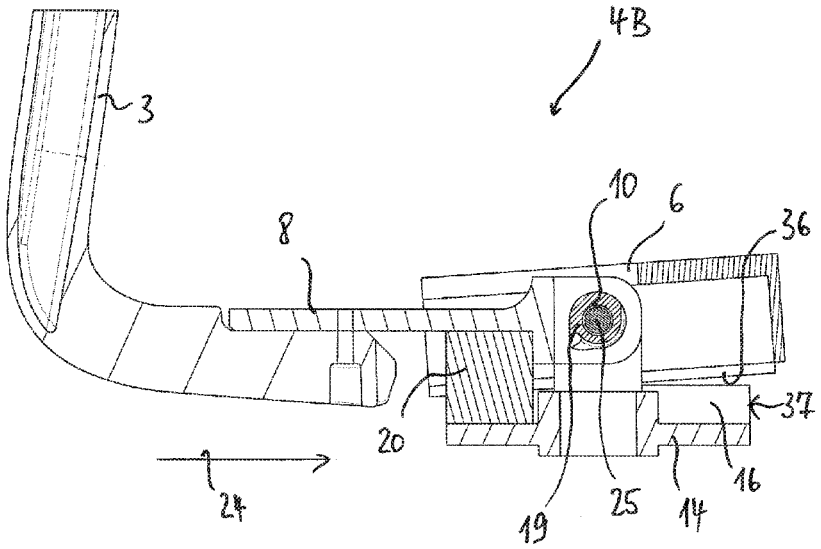
FIG. 18 shows a sectional view of the mechanism from FIG. 14 with the seat support pivoted backward.

FIG. 17 shows that when the seat support 6 pivots forward, when seen in the longitudinal direction 24 of the chair, the front end 37 of the first damping elements 16 is acted upon by the seat support 6, whilst the seat support 6 lifts from the rear end 38 of the first damping elements 16, see FIG. 14. As there is no coupling to the second damping 20, the seat support 6 pivoting forward has no effect on the backrest support 8. The same applies in a corresponding manner to the seat support 6 pivoting backward when seen in the longitudinal direction 24 of the chair, as shown in FIG. 18.

Figure 19:
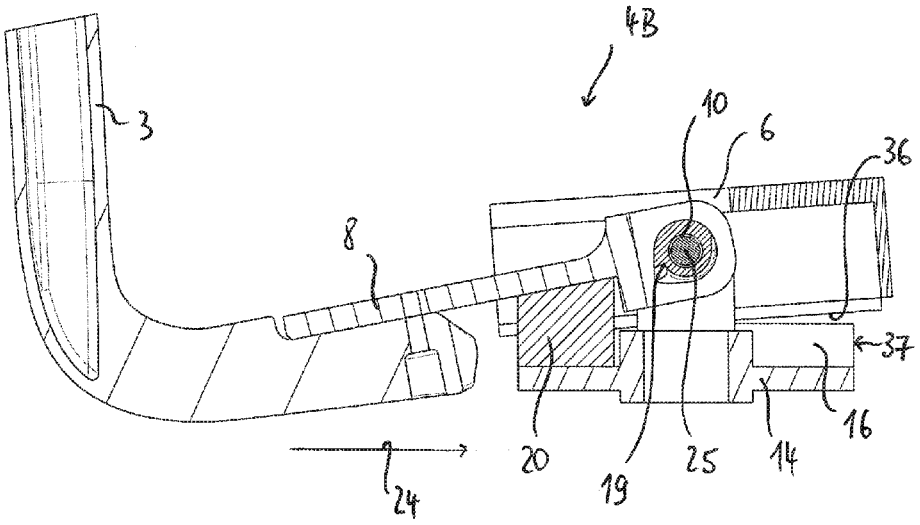
FIG. 19 shows a sectional view of the mechanism from FIG. 14 with the backrest support pivoted backward.
Figure 20:
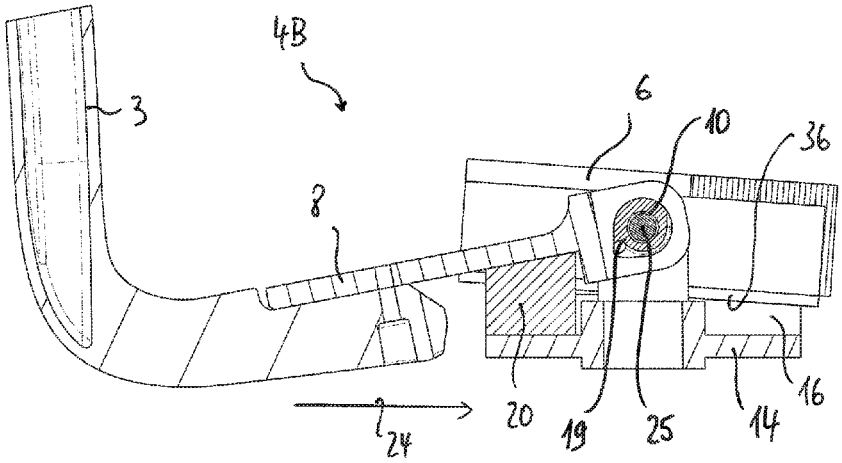
FIG. 20 shows a sectional view of the mechanism from FIG. 14 with the backrest support pivoted backward and the seat support pivoted forward.

The backrest support 8 is moved exclusively when the backrest 3 is loaded, that is to say when a user leans against the backrest 3, see FIG. 19. In this case, the second damping element 20 is acted upon by the backrest support 8 and also makes available a corresponding resetting force which—as also in all the other described exemplary embodiments—causes the backrest 3 with the backrest support 8 to pivot back into the initial position when the backrest is no longer loaded by the user 3.

There is no automatic subsequent movement in the case of the "B-type" mechanism such that no synchronous development is replicated either. However, as a result of the damping elements 16, 20, which are arranged separately from one another and are able to be actuated independently, the seat support 6 and the backrest support 8 can also be pivoted independently here, as shown, for example, in FIG. 20, where the backrest support 8, acted upon by a user leaning against it, is pivoted backward and the seat support 6, correspondingly acted upon by the user of the chair, is pivoted forward.

Figure 21:
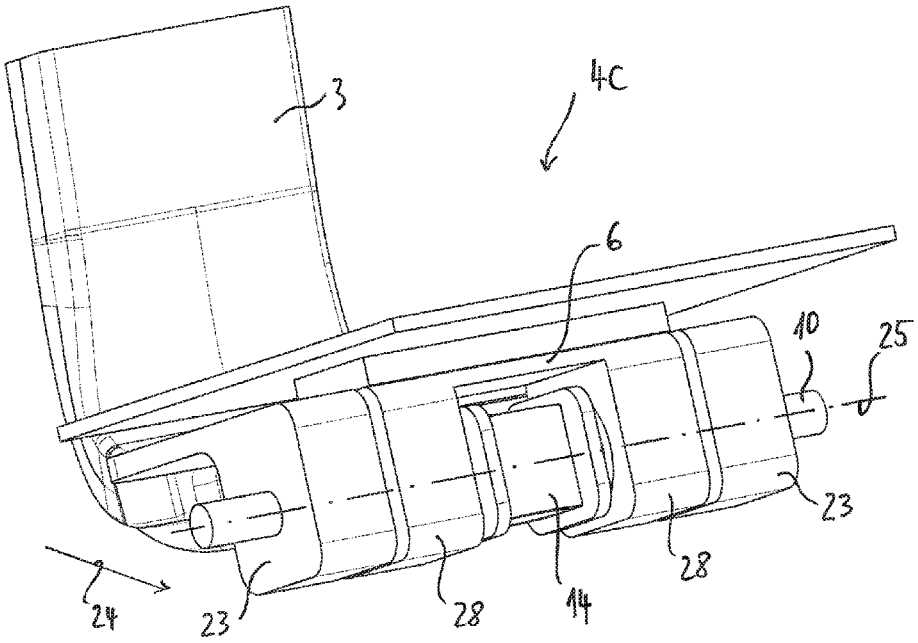
FIG. 21 shows a perspective sectional view of a "C-type" mechanism.
Figure 22:
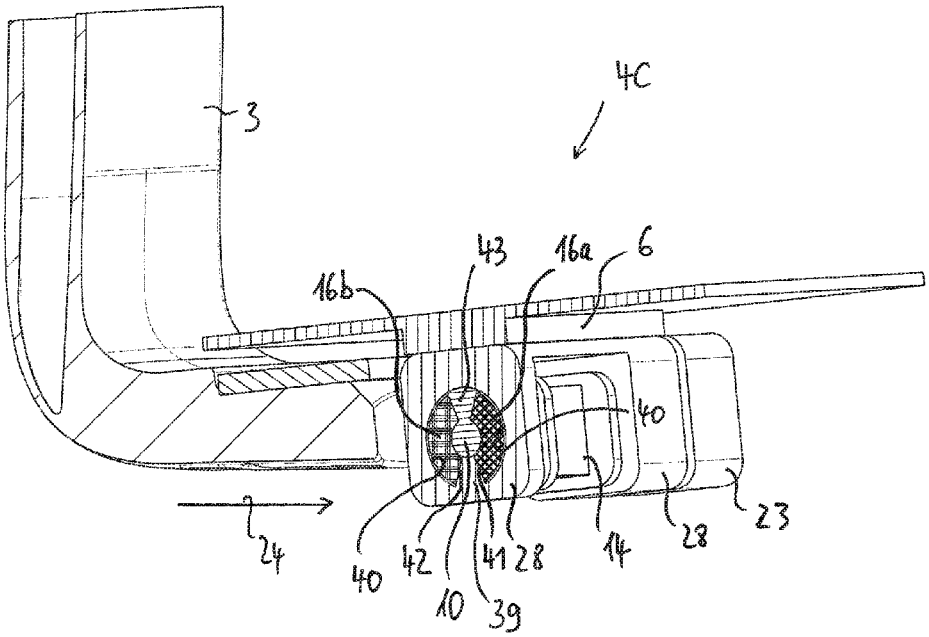
FIG. 22 shows a sectional view, in perspective, of the mechanism from FIG. 21 in the non-pivoted initial position.
Figure 23:
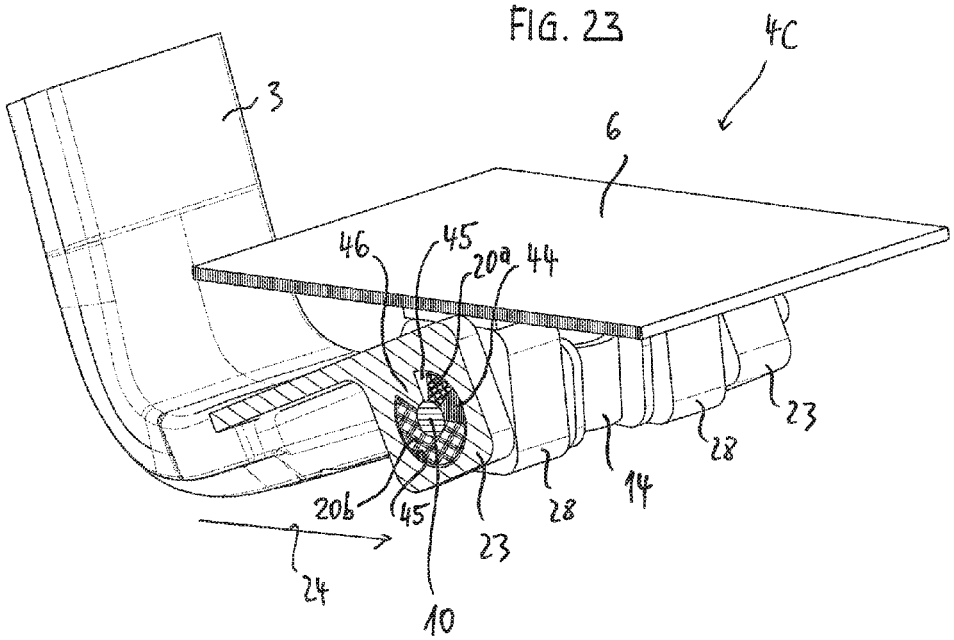
FIG. 23 shows a sectional view of the mechanism from FIG. 21 with the backrest support pivoted backward.

FIG. 21 to 23 show a "C-type" mechanism. In this case, as regards its operation, like the "A-type" mechanism this is a coupled mechanism 4C where the abutment for the second damping element 20 is formed by the seat support 6. The "C-type" mechanism differs from the "A-type" mechanism, however, by the form and arrangement of the damping elements 16, 20.

Once again, the center of the base support 14 with the tapered receiving means is flanked on both sides initially by the side walls 28 of the seat support 6, then outwardly by the cheeks 23 of the backrest support 8. The characteristic is that the damping elements 16, 20 are arranged in the interior of the side walls 28 and cheeks 23. As a result, the installation space required for the mechanism 4C is clearly reduced and an altogether clearly more compact mechanism 4C which is particularly flat is produced.

In contrast to the "A-type" and "B-type" mechanisms, where cuboid damping elements 16, 20 are used, the damping elements 16, 20 in this case are realized as blocks which are shaped in the manner of a segment of a ring arch and which, extending over a defined angular portion, encompass the pivot bolt 10 in each case in part. The damping elements 16, 20, in this case, are inserted in suitable receiving chambers inside the side walls 28 or cheeks 23.

Whereas FIG. 21 is a view from the outside of the mechanism 4C with the side walls 28 and cheeks 23 which receive the damping elements 16, 20, the section through a side wall 28 of the seat support 6 shown in FIG. 22 shows the form and arrangement of a front first damping element 16*a* and of a rear first damping element 16*b*. Two different materials for the front and rear first damping element 16*a*, 16*b* have been used here as an example in order to clarify that in this way it is possible to set a different pivot resistance for the seat support 6 pivoting forward in the longitudinal direction 24 of the chair than for the seat support 6 pivoting backward in the longitudinal direction 24 of the chair.

The two first damping elements 16*a*, 16*b* are separated from one another twice. On the one hand, with the seat support 6 in the non-pivoted initial state, the damping elements 16*a*, 16*b* abut by way of their one end against an entrainment means 39 of the seat support 6, which extends radially in the direction of the pivot pin 10 in the manner of an overhang from the outside wall of the receiving chamber 40, and form stop surfaces 41, 42, which extend both forward and backward in the longitudinal direction 24 of the chair, for acting upon the damping elements 16*a*, 16*b*. Thus, when the seat support 6 pivots backward in the longitudinal direction 24 of the chair, the front first damping element 16*a* is acted upon by the forwardly pointing stop surface 41 and by the seat support 6 pivoting forward in the longitudinal direction 24 of the chair and the rear first damping element 16*b* is acted upon by the rearwardly pointing stop surface 42.

On the other hand, in the non-pivoted initial state, the damping elements 16*a*, 16*b* abut by way of their oppositely situated other ends against an immovable part of the base support 14, which serves as abutment 43 and, proceeding from the center of the base support 14, extending transversely to the longitudinal direction 24 of the chair, projects into the receiving chamber 40 of the first damping elements 16*a*, 16*b*. The abutment 43 extends in this case, just as the entrainment means 39, from the pivot pin 10 to the outside wall of the receiving chamber 40. In the present example, the abutment 43 is fixedly connected in an integral manner to the pivot pin 10 and corresponds in its form to the entrainment means 39 of the seat support 6, the pivot pin 10 being fixedly connected, in turn, to the base support 14.

In the example shown here, the front and rear first damping elements 16*a*, 16*b* and the receiving chambers 40 provided for them are the same size. At the same time, the entrainment means 39 and the abutment 43 are precisely opposite one another, the entrainment means 39, when seen from the pivot pin 10, pointing downward with the seat support 6 in the non-pivoted initial state, and the abutment 43 pointing upward. In the initial state, therefore, the entrainment means 39 is at a 6 o'clock position, whereas the abutment 43 is arranged in a 12 o'clock position. However, both the size of the damping elements 16*a*, 16*b* and the position of the entrainment means 39 and/or of the abutment 43 can be varied in order to realize certain pivot characteristics.

The section through a cheek 23 of the back rest support 8 shown in FIG. 23 illustrates the form and arrangement of a second damping element 20 of said mechanism 4C.

So that the desired coupling between a movement of the seat support 6 and the backrest support 8 can be achieved once again, a second entrainment means 44 of the seat support 6, which corresponds in form and realization to the above-described first entrainment means 39, extends transversely with respect to the longitudinal direction 24 of the chair into the receiving chamber 45 of the second damping element 20 realized in the interior of the cheek 23 of the backrest support 8 and there forms the abutment for the second damping element 20 when the second damping element 20 is acted upon by the backrest support 8. With the backrest support 8 in the initial state, said abutment 44 is approximately in a 2 o'clock position. The entrainment means 46 of the backrest support 8, which, in the initial position, is arranged approximately in a 11 o'clock position, once again extends radially as a type of overhang from the outside wall of the receiving chamber 45 in the direction of the pivot pin 10. It also realizes corresponding stop surfaces both forward and backward in the longitudinal direction 24 of the chair for acting upon the two second damping elements 20*a*, 20*b*.

In this case, the "rear" second damping element 20*b*, which—as can be seen from the arrangement of the entrainment means 46 and the abutment 44—extends over a clearly larger angular portion than the "front" second damping element 20*a*, is inserted in such a manner between the entrainment means 46 and the abutment 44 in the receiving chamber 45 that the backrest support 8 pivoting into the pivoting state, as shown in FIG. 23, causes an impingement of the "rear" second damping element 20*b* which consequently determines the pivot resistance of the backrest 8. At the same time, the "rear" second damping element 20*b* presses by way of its other end against the abutment 44, which is realized as part of the seat support 6, such that said pivoting backward of the backrest support 8 causes the seat support 6 to pivot backward as a subsequent movement.

The "front" second damping element 20*a* which, with the backrest support 8 in the initial position, abuts against the stop surface of the entrainment means 46 of the backrest support 8, which points forward in the longitudinal direction 24 of the chair, is acted upon by the abutment 44 formed by the seat support 6 when the seat support 6 pivots backward and causes the backrest support 8 to pivot backward into the same direction as a subsequent movement. Equally, when the seat support 6 pivots forward, the "rear" second damping element 20*b* can be acted upon by the abutment 44 which is formed by the seat support 6, which causes the backrest support 8 to pivot into the same direction, that is to say forward, as a subsequent movement.

FIG. 24 to 27 show a "D-type" mechanism. In this case, as regards its operation, like the "B-type" mechanism this is an uncoupled mechanism 4D where the abutment for the second damping element 20 is not formed by the seat support 6 but by the base support 14. Just as in the case of the "C-type" mechanism, however, the damping elements 16, 20 in this case are once again arranged around the pivot pin.

Figure 24:
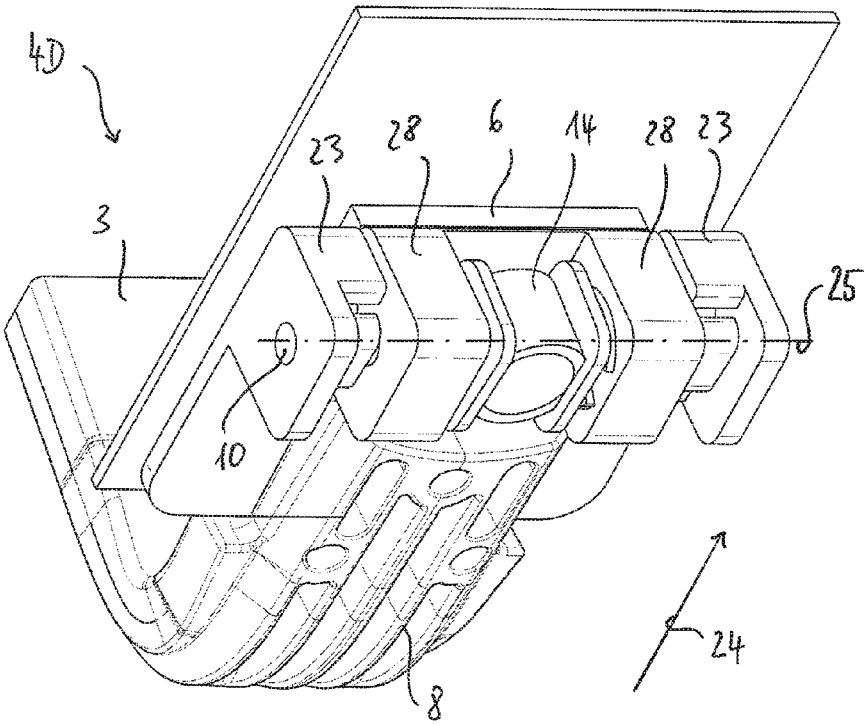
FIG. 24 shows a perspective sectional view of a "D-type" mechanism.
Figure 25:
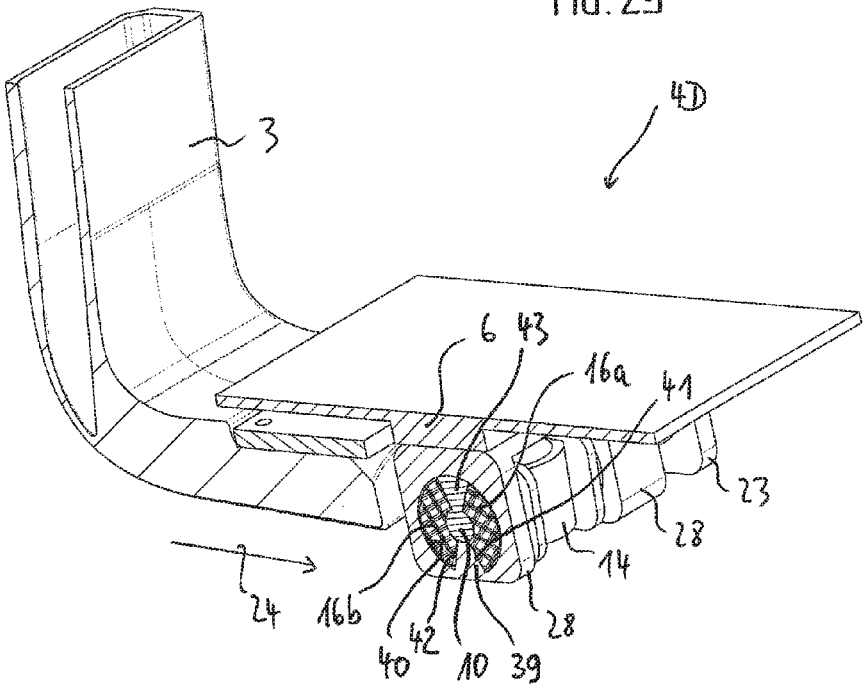
FIG. 25 shows a sectional view of the mechanism from FIG. 24 in the non-pivoted initial position.

Whereas FIG. 24 is a view from the outside of the mechanism 4D with the side walls 28 and cheeks 23 which receive the damping elements 16, 20, the section through a side wall 28 of the seat support 6 shown in FIG. 25 shows the form and arrangement of a front first damping element 16*a* and a rear first damping element 16*b*. Said design corresponds substantially to the design of a "C-type" mechanism, as shown in FIG. 22.

Figure 26:
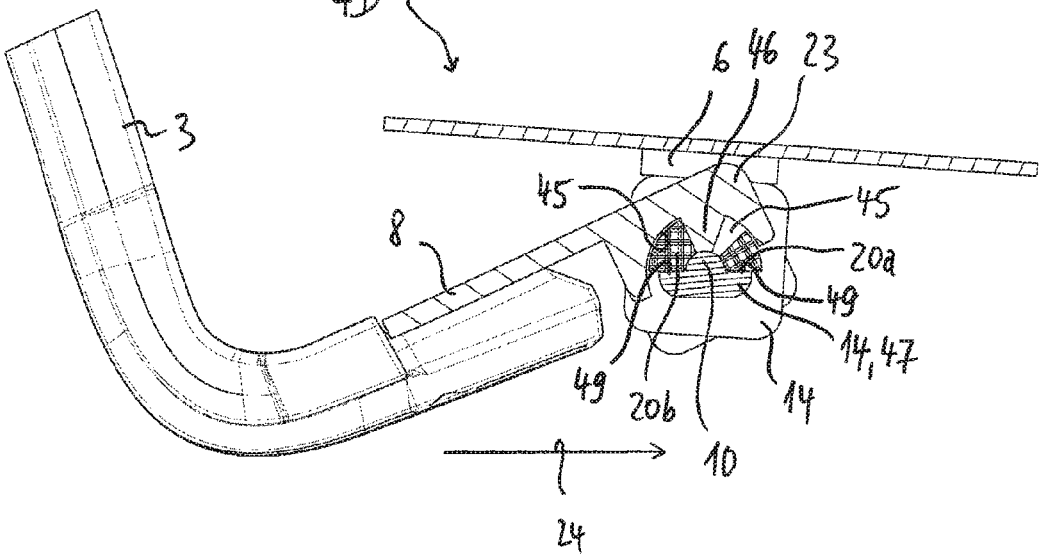
FIG. 26 shows a sectional view of the mechanism from FIG. 24 with the backrest support pivoted backward.

FIG. 26 shows a section through a cheek 23 of the backrest support 8. In contrast to the "C-type" mechanism, there are no components of the seat support 6 which project into the receiving chamber 45 such that, as in the case of the "B-type" mechanism, no subsequent movements are possible due to the lack of a coupling between the seat support 6 and the backrest support 8. Instead of which, the base support 14 once again forms the abutment 47 for the two second damping elements 20*a*, 20*b*, which can be acted upon in a known manner by the entrainment means 46 of the backrest support 8 when the backrest 3 pivots. The abutment 47, in this case, is realized as a molding of the pivot bolt 10 which points forward and backward in the longitudinal direction 24 of the chair and in the initial state realizes horizontal, upwardly pointing contact surfaces 49 for the second damping elements 20*a*, 20*b*. The pivot bolt 10 with its contact surfaces 49, as in the case of the above-described "C-type" mechanism, is connected in an immobile manner to the base support 14 and can consequently be seen structurally, in any event however functionally, as a component of the base support 14.

In the example shown here, with the backrest support 8 in the initial state, the entrainment means 46 is arranged approximately in a one o'clock position. When the backrest support 8 pivots backward, the entrainment means 46 is moved, for example, into the 12 o'clock position, as shown in FIG. 26, and consequently acts upon the "rear" second damping element 20*b* which strikes with its opposite end against the rear contact surface 49 of the abutment 47. Once again the pivot resistance of the backrest 3 is defined as a result of said "rear" second damping element 20*b*. The shorter "front" second damping element 20*a* serves for damping the backrest 3 pivoting forward.

As the common pivot axis 25 and the vertical center longitudinal axis 29 of the chair column 5 intersect in the center of the base support 14, as already described in conjunction with the embodiments described in FIG. 1 to 7, also in the case of "A-type" to "D-type" mechanisms, the pivot axis 25, more precisely the pivot bolt 10, can serve as a support for a gas spring triggering element, for example in the form of a gas spring height adjustment ring 19. Said height adjustment ring 19 is realized, for example, in an eccentric manner and is realized for suspending a Bowden cable (not shown) or another pulling means such that when the Bowden cable is pulled, a gas spring pin that is mounted on the top end of the gas spring 5 is depressed and consequently the gas spring 5 is actuated.

As a result of a suitable resilient bearing arrangement of the pivot bolt 10 in the base support 14, for example by means of rubber rings 22 or the like, lateral pivotability of the mechanism 4 can also be realized over and above this in the case of the last described exemplary embodiments.

The invention is not restricted to the described exemplary embodiments. Thus, other examples can also realize the inventive core concepts. Thus, for example, the common pivot axis 25 does not necessarily have to be the only pivot axis of the entire mechanism 4. It is also possible for the mechanism 4 to have further pivot axes so long as at all events the common pivot axis 25 is the only pivot axis that connects the seat support 6 and the backrest support 8 together. The concept of the damping elements 16, 20 with different degrees of resilience arranged between individual components of the mechanism 4 can also be transferred to such office chair mechanisms that comprise more than one pivot axis.

All the features shown in the description, the following claims and the drawing can be fundamentally inventive both on their own and in arbitrary combinations together. In particular, developments described above in conjunction with a mechanism can also be realized in other mechanisms as a result of corresponding application.

LIST OF REFERENCES

1 Office swivel chair, office chair
2 Sitting surface
3 Backrest
4 Support structure, mechanism
5 Gas spring, chair column
6 Seat base, seat support
7 Backrest adapter
8 Back base, backrest support
9 End face
10 Pivot bolt
11 Bearing block
12 Bearing bush
13 Bearing bush
14 Gas spring base, base support with tapered receiving means
15 Inside lateral surface
16 Resilient ring element
17 Shoulder
18 Flange
19 Gas spring height adjustment ring
20 Resilient damping element
21 Back-locking element
22 Rubber ring
23 Cheek of the backrest support
24 Longitudinal direction of the chair
25 Pivot axis
26 Bearing bush
27 Side wall of the base support
28 Side wall of the seat support
29 Center longitudinal axis of the chair column
30 Blocking element
31 Receiving opening
32 Receiving opening
33 Receiving opening
34 Central backrest support element
35 Base plate of the base support
36 Side wall end
37 Front end
38 Rear end
39 First entrainment means of the seat support
40 Receiving chamber of the first damping element
41 Front stop surface

42 Rear stop surface
43 Abutment
44 Second entrainment means of the seat support, abutment
45 Receiving chamber of the second damping element
46 Entrainment means of the backrest support
47 Abutment
49 Contact face
104 Support structure
114 Gas spring base

The invention claimed is:

1. A mechanism for an office chair, the mechanism comprising:

a base support to be mounted on a chair column;

a seat support and a backrest support pivotally mounted about a common pivot axis, said pivot axis being a single and only common pivot axis between said seat support and said backrest support;

said seat support being articulated to said base support by way of at least one pivot bolt and being pivotable relative to said base support; and said backrest support being articulated to said base support by way of said at least one pivot bolt and being pivotable relative to said base support;

at least one first resilient damping element being acted upon by pivoting of said seat support;

at least one second resilient damping element being acted upon by pivoting said backrest support;

said at least one first and second resilient damping elements are cuboid, ring shaped or ring segmented blocks with a material dependent resilience.

2. The mechanism according to claim 1, wherein said pivot axis is a single and only pivot axis of the mechanism.

3. The mechanism according to claim 1, wherein said at least one resilient damping element is arranged between said base support and said seat support.

4. The mechanism according to claim 1, wherein said at least one resilient damping element is arranged between said backrest support and said seat support.

5. The mechanism according to claim 1, wherein said at least one resilient damping element is arranged between said backrest support and said base support.

6. The mechanism according to claim 1, comprising at least one first resilient damping element which is acted upon when said seat support is pivoted and at least one second resilient damping element which is acted upon when said backrest support is pivoted.

7. The mechanism according to claim 6, wherein said at least one first resilient damping element is arranged between said base support and said seat support and said at least one second resilient damping element is arranged between said backrest support and said seat support or between said backrest support and said base support.

8. The mechanism according to claim 6, wherein said at least one first resilient damping element has a resilience different from a resilience of said at least one second resilient damping element.

9. The mechanism according to claim 1, further comprising a multistage locking arrangement for locking the displacement movements a said seat support and/or said backrest support, said locking arrangement to be actuated by a linear displacement of a single blocking element.

10. A mechanism for an office chair, the mechanism comprising:

a base support to be mounted on a chair column;

a seat support and a backrest support pivotally mounted about a common pivot axis;

said seat support being articulated to said base support by way of at least one pivot bolt and being pivotable relative to said base support;

said backrest support being articulated to said base support by way of said at least one pivot bolt and being pivotable relative to said base support; and a gas spring triggering element for triggering a gas spring located in said chair column, said triggering element being arranged on said at least one pivot bolt.

11. An office chair, comprising:

a chair column; and a mechanism according to claim 1 disposed on said chair column.

* * * * *